US012534919B2

(12) United States Patent
Burt et al.

(10) Patent No.: US 12,534,919 B2
(45) Date of Patent: Jan. 27, 2026

(54) REINFORCED ADJUSTABLE STAIR TRAY

(71) Applicant: Fortress Iron, LP, Garland, TX (US)

(72) Inventors: Kevin Troy Burt, Dallas, TX (US); Michael J. Sawka, Garland, TX (US)

(73) Assignee: Fortress Iron, LP, Garland, TX (US)

( * ) Notice: Subject to any disclaimer, the term of this patent is extended or adjusted under 35 U.S.C. 154(b) by 228 days.

(21) Appl. No.: 18/395,208

(22) Filed: Dec. 22, 2023

(65) Prior Publication Data

US 2025/0207405 A1 Jun. 26, 2025

(51) Int. Cl.
*E04F 11/104* (2006.01)
*E04F 11/025* (2006.01)

(52) U.S. Cl.
CPC ..... *E04F 11/1041* (2013.01); *E04F 11/0255* (2013.01)

(58) Field of Classification Search
CPC ..... E04F 11/104; E04F 11/1041; E04F 11/09; E04F 11/022; E04F 11/025; E04F 11/0255; E04F 2011/1046; E04F 2011/0209
See application file for complete search history.

(56) References Cited

U.S. PATENT DOCUMENTS 1,960,863 A * 5/1934 Troy ..... E06C 7/16 182/228.1
2,852,854 A * 9/1958 Danen ..... E04F 21/26 33/561.3
3,474,882 A * 10/1969 Ernst ..... E04F 11/035 182/178.1
4,586,585 A 5/1986 Zaner
5,349,795 A * 9/1994 French ..... E04F 11/022 52/183
11,085,191 B2 8/2021 Burt et al.
11,753,829 B2 * 9/2023 Charette ..... E04F 11/112 52/182
2003/0208971 A1 11/2003 Couture
2009/0188183 A1 7/2009 Sorenson
(Continued)

FOREIGN PATENT DOCUMENTS

CN 111021649 A 4/2020
EP 0 662 549 B1 7/1995

OTHER PUBLICATIONS

Fortress Building Projects, "Installation Instructions" in Deck & Stair Kit Installation: Freestanding Frame and Stair Kit Instructions, (Aug. 2022), pp. 1-70.

(Continued)

*Primary Examiner* — Jessica L Laux
(74) *Attorney, Agent, or Firm* — Foley & Lardner LLP; John J. May

(57) ABSTRACT

An adjustable stair tray assembly includes a first angle bar, a plurality of track channels coupled to the first angle bar with each defining a cavity. A plurality of U-channels is coupled to a second angle bar, and each one of the plurality of U-channels is received in a respective cavity of each of the plurality of track channels. The second angle bar comprises a horizontal wall, a vertical wall extending from the horizontal wall, and a reinforcing flange extending downwardly from the vertical wall. A plurality of U-channels is coupled to the second angle bar, the plurality of U-channels is telescopically adjustable within the plurality of track channels to adjust a tray depth of the adjustable stair tray assembly.

20 Claims, 10 Drawing Sheets

(56) References Cited

U.S. PATENT DOCUMENTS

| | | | | |
|---|---|---|---|---|
| 2011/0239556 | A1 | 10/2011 | Burford et al. | |
| 2015/0211234 | A1 | 7/2015 | Lanphear | |
| 2020/0109567 | A1* | 4/2020 | Burt | E04F 11/0255 |
| 2020/0407980 | A1* | 12/2020 | Spremulli | E04F 11/1041 |

OTHER PUBLICATIONS

International Search Report and Written Opinion in PCT/US2024/061001 Dtd Mar. 6, 2025.

* cited by examiner

REINFORCED ADJUSTABLE STAIR TRAY

BACKGROUND

Stairways require skill and expertise to assemble. Many variables factor into a particular stairway. For example, stairways may have different total rise and total run dimensions. These dimensions determine the angle of the stairway. Trays for supporting a stair tread typically have a fixed depth, and therefore the stair parameters need to be determined to accommodate this fixed depth. In the alternative, the overall stairway parameters may be determined, and a fixed depth stair tray may be fabricated on site or purchased. Employing an adjustable depth stair tray permits flexibility in determining multiple parameters of a stairway. Moreover, a manufacturer may provide one adjustable depth stair tray, as opposed to multiple fixed depth stair trays, to reduce SKUs held by a distributor or retailer. The present disclosure provides a stair system that may be easier to construct and may be more versatile in allowing stairway construction with multiple stair tray depths with the same components.

Fortress Building Products Freestanding Frame and Stair Kit Instructions for its Evolution Steel Deck Framing product discloses an adjustable stair tray for use with an adjustable stair step support bracket and stair calculator. The stair calculator is used to determine the number of steps and the angle of the stairway along with the rise and run of each individual step. The adjustable stair tray allows adjustment of the run of each step as the depth of the adjustable stair tray. The adjustable stair tray spans four feet with a stair stringer supporting each adjustable stair tray on each side. This span may result in undesired deflection of the adjustable stair tray if a certain load is applied proximate the center of the adjustable stair tray. One solution is to add a stair stringer to support the middle of the adjustable stair tray. This solution adds additional expense to the deck frame along with the time and effort to construct the third stair stringer. An alternative solution to this unintended deflection issue is disclosed herein.

SUMMARY OF THE INVENTION

According to a first aspect, a reinforced adjustable stair tray assembly includes a first angle bar, and a plurality of track channels coupled to the first angle bar with each defining a cavity. A plurality of U-channels is coupled to a second angle bar, and each one of the plurality of U-channels is received in a respective cavity of each of the plurality of track channels. The plurality of U-channels is telescopically adjustable within the plurality of track channels to adjust a tray depth of the adjustable stair tray assembly. The adjustable stair tray is reinforced with a reinforcing flange that extends downwardly from a vertical wall of a second angle bar disposed at the rear of the adjustable stair tray. According to an embodiment, the reinforcing flange increases strength and resistance to yielding of the adjustable stair tray, particularly when the reinforced adjustable stair tray is used with one stair stringer supporting each side of the tray, and the tray spans approximately four feet.

According to a second aspect, an adjustable stair system includes a stringer comprising a lateral wall and an upper wall, the stringer is configured to support a plurality of stair tray support brackets. The adjustable stair system further includes a reinforced adjustable stair tray assembly configured to be supported by a subset of the plurality of stair tray support brackets. The reinforced adjustable stair tray assembly has a rear angle bar formed of a vertical wall and a horizontal wall. The rear angle bar also includes a reinforcing flange that may be formed by a flat hem such that the reinforcing flange extends downwardly from the vertical wall. A plurality of U-channels is connected to a bottom surface of the horizontal wall of the rear angle bar. The reinforced adjustable stair assembly further includes a front angle bar formed of a vertical wall and a horizontal wall, which a plurality of track channels connected to a bottom surface of the horizontal wall of the front angle bar. Each of the plurality of track channels has a top wall, a pair of sidewalls extending from the top wall, and a bottom wall laterally extending from each respective sidewall toward the other sidewall. The plurality of track channels receives the plurality of U-channels to allow for depth adjustability to multiple stair tray depths.

According to other embodiments, the multiple stair tray depths include a range of 8-14 inches. According to another embodiment, the multiple stair tray depths include a range of 10 to 12 inches.

In some embodiments, the track channels are hollow rectangular tubes.

In other embodiments, at least one of the plurality of track channels is welded to a portion of the front angle bar.

According to some embodiments, at least one of the plurality of track channels includes a through hole configured to facilitate welding to the angle bar.

According to yet another embodiment, the adjustable stair system further includes a self-drilling fastener extending through the one of the angle bars and into an upper surface of a stair tray support bracket.

In some embodiments, the top wall of each of the plurality of track channels is disposed flush with a top surface of the lateral portion of the front angle bar.

According to other embodiments, a top surface of the horizontal wall of the front angle bar is co-planar with a top surface of the horizontal wall of the rear angle bar.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Homeowners enjoy outdoor living spaces, such as outdoor decks. Deck frames may be constructed of wood or metal, for example light gauge steel. Stairways may be constructed to allow access to elevated outdoor deck areas. Stairways are constructed with a variety of rise angles and run dimensions. The rise angles may also be referred to as incline angles, pitch angles, stair angles or similar terms. The run dimension refers to the depth of the stair treads. A typical stairway may have an incline angle measured from the horizontal of 30-50 degrees and a run dimension between 7 inches and 11 inches. Building codes and other regulations may govern stairways to ensure that they are constructed to be safely and comfortably ascended and descended. As an example, it is common to have a stair rise of approximately 7-8 inches and a stair tread depth of approximately 9-11 inches.

The width of a stairway is another parameter that may be governed by one or more building codes or other regulations. As an example, it is advisable that the horizontal space between railings of a stairway is at least 36 inches. This horizontal space is the un-obstructed horizontal distance or space through which an upper body of an individual ascending or descending the stairway passes. If wider stairway space is desired, additional stair stringers may be necessary to support the wider stair treads. Posts to support a railing panel may be mounted directly to the stair tread surface. However, if increased horizontal space is desired, the railing panel support posts may be mounted directly to the stringers that support the stair treads. According to some embodiments, the stairs may lead from a ground surface to an elevated deck surface of an outdoor deck.

In constructing a stairway, it is desirable to use similarly designed rail panels, posts, and stair stringers to construct safe and comfortable stairways at multiple different stair tread depths. This is particularly true if the stairway is to be constructed of metal and the construction does not include custom welding at the job site.

Figure 1:
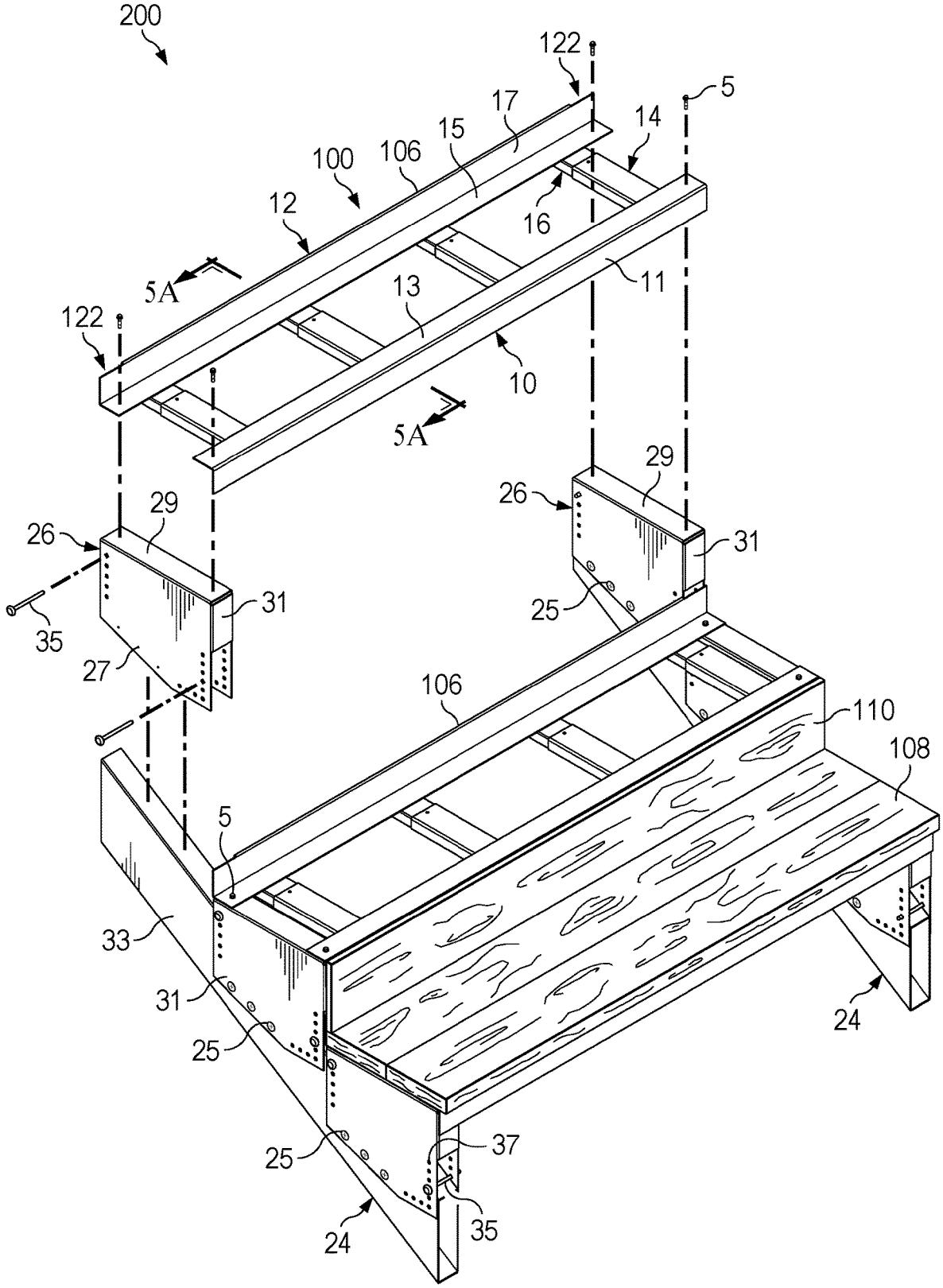
FIG. 1 is a partially exploded, perspective view of an embodiment of an adjustable stair system with an embodiment of a reinforced adjustable stair tray assembly.

Reference is now made to FIG. 1, which is a perspective, partially exploded view of an adjustable stair system 200 that employs an embodiment of a reinforced adjustable stair tray assembly 100 according to the teachings of the present disclosure. The adjustable stair system 200 includes a pair of stair stringers 24, a plurality of stair tray support brackets 26, and a plurality of reinforced adjustable stair tray assemblies 100. The stair stringers 24 are disposed spaced apart from each other and define a width of the stair system 200. Each stair stringer 24 may be formed of sheet metal, for example light gauge steel or aluminum. The stair stringers 24 are configured to support the plurality of stair tray support brackets 26. According to an embodiment, the stair stringers 24 are similar to tube joists in that they are in the form of a continuous tube with a generally rectangular cross-sectional shape. Stair stringers 24 with other shapes are contemplated by this disclosure. For example, a metal stair stringer may be C-shaped in cross section. Alternatively, the stair stringer may be a piece of lumber.

A plurality of stair tray support brackets 26 mounted to a stair stringer 24 may be referred to as a stair stringer assembly. The stair tray support brackets 26 are configured to be connected to or otherwise secured to the stair stringers 24 by inserting self-drilling screws 25 into through holes 27 in the sidewalls 31 of the stair tray support bracket 26 and through a corresponding sidewall 33 of the stair stringer 24. In another embodiment, the stair tray support bracket 26 can be secured to the stair stringer 24 by welding the stair tray support bracket 26 directly to the stair stringer 24. Such welding can utilize metal inert gas ("MIG") welding, arc welding, tungsten inert gas ("TIG") welding, also known as gas tungsten arc welding ("GTAW"), or any other suitable form or technique of welding.

According to an embodiment, the stair tray support bracket 26 may be a rise adjustable stair tray support bracket 26 according to the teachings of U.S. Pat. No. 11,085,191, titled "Stair Assembly with Rise Adjustable Step Support Brackets," assigned to Fortress Iron, LP, and incorporated herein by reference. An installer may use set pins 35 received through set pin holes 37 to position an upper wall 29 of the stair tray support brackets 26 level for multiple different incline angles of the stair stringer 24. In this manner, the flexibility of the stair system parameters may be increased while using the same components to construct stair systems having different parameters.

The reinforced adjustable stair tray assembly 100 is positioned on the stair tray support brackets 26 and fasteners 5 are inserted through the adjustable stair tray assembly 100 and into the upper wall 29 of the brackets 26, as explained in more detail below. The reinforced adjustable stair tray assembly 100 supports stair treads 108 formed of a suitable material, for example a composite polymeric material used in constructing outdoor decks. The stair treads 108 provides the walking surface for the adjustable stair system 200. The stair system may also include stair risers 110.

The reinforced adjustable stair tray assembly 100 is positioned on the stair tray support brackets 26 such that the upper wall 29 of the stair tray support bracket 26 contacts the lower surfaces of the horizontal wall 13 of the front angle bar 10 and the horizontal wall 15 of the rear reinforced angle bar 12. The inner surface of the vertical wall 11 of the front angle bar 10 is disposed to abut the front wall 31 of the stair tray support bracket 26. The rear reinforced angle bar 12 is positioned to abut an adjacent stair tray support bracket 26. The spacing of the tray support brackets 26 and the corresponding depth of the reinforced adjustable stair tray assemblies 100 provide a constant and easily repeatable stair tread depth according to the teaching of the present disclosure. Fasteners 5, for example self-drilling screws, are inserted through the horizontal wall 13 and the horizontal wall 15 and into the upper wall 29 of the stair tray support bracket 26.

Figure 2A:
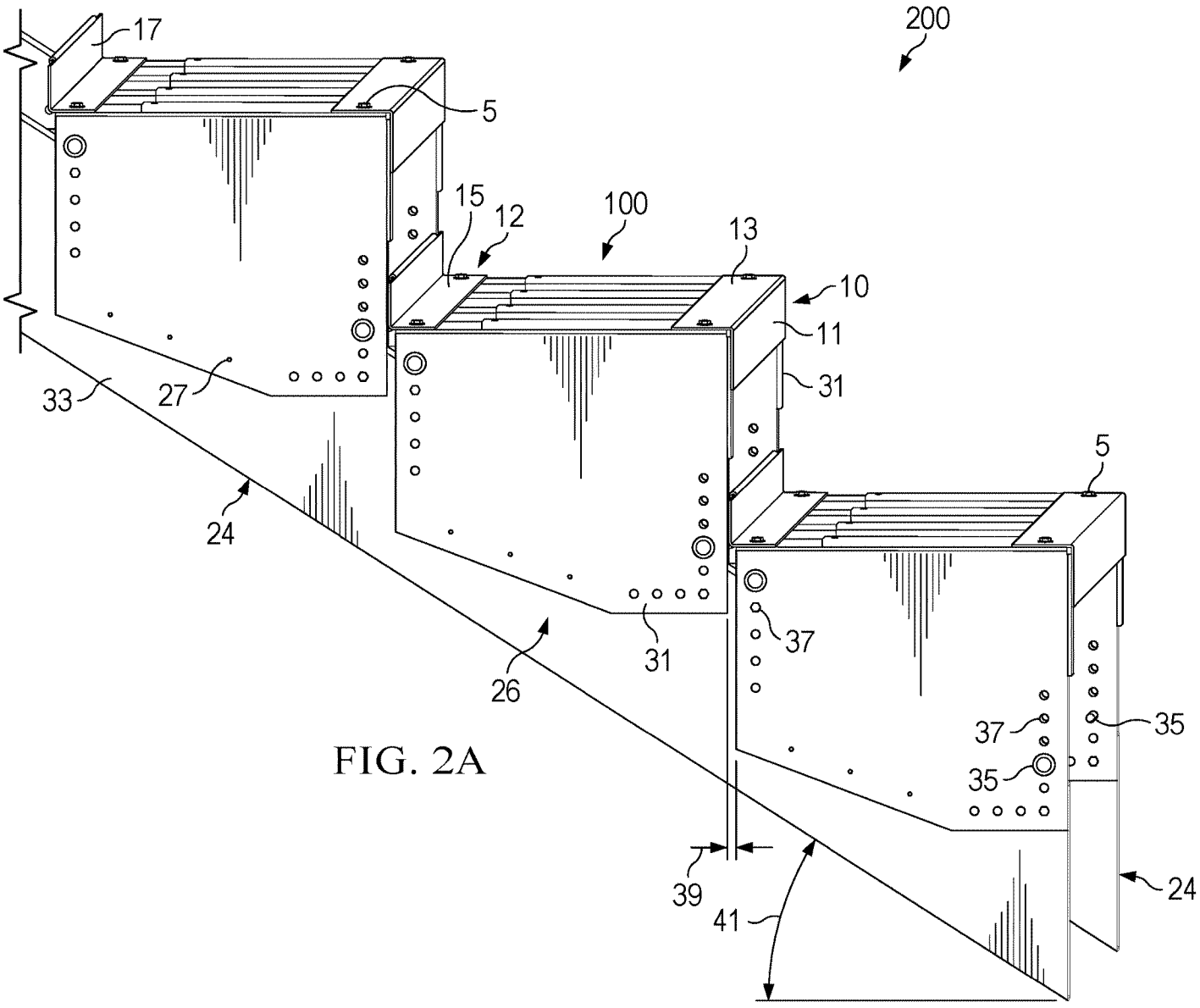
FIGS. 2A and 2B are perspective views of a portion of the adjustable stair system of FIG. 1 with stair tray support brackets positioned at different spacing dimensions.
Figure 2B:
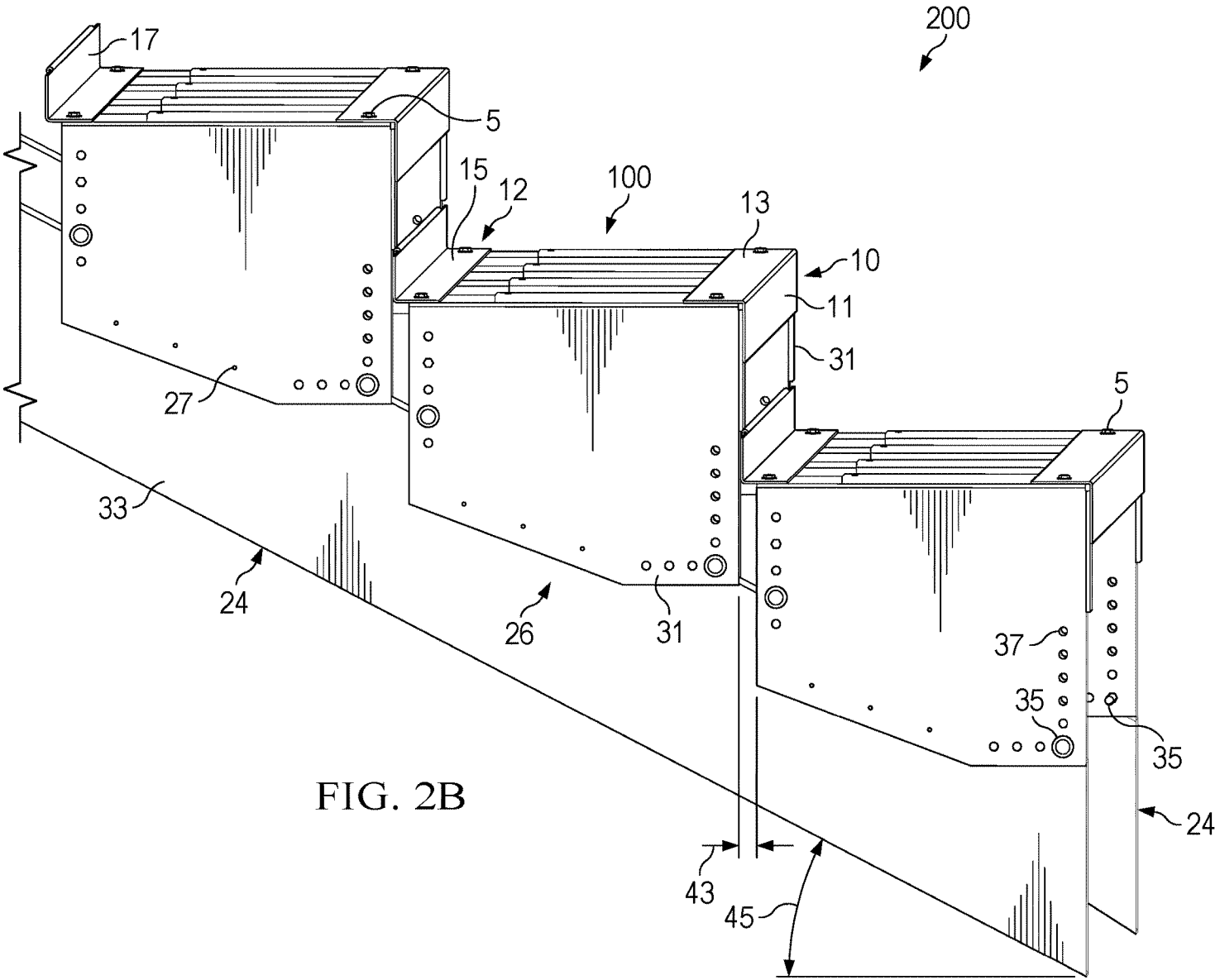

Reference is now made to FIGS. 2A and 2B. FIG. 2A is a perspective view of the stair system 200 with the stair tray support brackets 26 spaced apart a predetermined horizontal distance 39 from each other. The stair system shown in FIG. 2A has an incline angle 41 of approximately 36 degrees. The stair tray support brackets 26 support the adjustable stair trays 100 extended or retract to accommodate the predetermined horizontal distance 39 between the stair tray support brackets 26.

FIG. 2B is a perspective view of the stair system 200 with the stair tray support brackets 26 spaced apart a predetermined horizontal distance 43 from each other. An incline angle 45 for the stair system 200 shown in FIG. 2B may be approximately 30 degrees. The set pin holes 37 that correspond to the incline angle 45 may be different than the set pin holes 37 that correspond to the incline angle 41. The predetermined horizontal distance 43 shown in FIG. 2B is greater than the predetermined horizontal distance 39 shown in FIG. 2A.

A reinforced adjustable stair tray assembly 100 according to the teachings of the present disclosure expands and retracts to accommodate both distances 39, 43. More specifically, the telescoping adjustability of the reinforced adjustable stair trays 100 allows the adjustable stair tray to accommodate both distance 39 and distance 41 by expanding or collapsing the adjustable stair tray 100. According to an embodiment, the reinforced adjustable stair tray 100 may adjust from a retracted depth dimension 47 of ten inches (see FIG. 5A) to an expanded depth dimension 49 of twelve inches (see FIG. 5B). This adjustability to accommodate a range of predetermined spacing between stair tray support brackets 26 allows an installer to use the same stair tray support brackets 26 and reinforced adjustable stair tray assembly 100 to install stair systems 200 at a variety of incline angles and other stair parameters.

According to an embodiment, certain dimensions of the adjustable stair system 200 may be determined by a stair calculator. A contractor or stair installer may input certain parameters of a desired stair system 200 into a software tool programed to output dimensions to aid the contractor in constructing the stair system 200. For example, a contractor may input a desired total rise dimension of the stairway, a tray depth dimension, and a tread thickness dimension into the stair calculator. The stair calculator returns dimensions for the rise of each step, the incline angle, the bracket spacing dimension, the stair stringer length, and pin hole locations in the stair tray support bracket 26 that correspond to the determined incline angle.

The stair calculator accounts for various factors such as the number of steps required, the rise and run of each step, and the total rise of the stair system 200. According to one embodiment, a user enters a total rise dimension of nine feet, a tray depth dimension of eleven inches, a total run dimension of $146\frac{15}{32}$ inches, and stair tread thickness dimension of one inch. The stair calculator provides a number of steps corresponding to the total rise and total run values, calculates the desired inputs with known dimensions of the stair tray support bracket 26 and returns values of $7\frac{23}{32}$ inches step rise, an incline angle of 36 degrees, a stair stringer length of $179\frac{27}{32}$ inches, and a bracket spacing value of $10\frac{15}{32}$ inches. The bracket spacing dimension may be measured from the front of a front bracket 26 a distance of $10\frac{15}{32}$ inches toward an upper bracket and a mark is made on the stair stringer 24. The next bracket 26 may be secured to the stair stringer 24 with the front wall of that bracket 26 aligned with the mark on the stair stringer 24.

The adjustable stair system calculator provides a fast and accurate way to determine the dimensions of the adjustable stair system 200, making it a useful tool for architects, builders, and contractors. By inputting the required information into the calculator, users can quickly generate a set of dimensions that can be used to design and construct the stair system. The use of an adjustable stair system calculator can also help ensure that the stair system meets building codes and safety standards. Moreover, each of the stair stringers 24 may be measured and cut to the measured dimension, and the stair tray support brackets 26 may be positioned and secured to the stringers 24. The combined stringers 24 and stair tray support brackets 26 may then be secured to an upper outdoor deck and a lower landing. Once the combined stringers 24 and brackets 26 are in place, then the reinforced adjustable stair tray assemblies 100 may be secured to the brackets 26, as discussed in more detail with respect to FIGS. 6A and 6B. In this manner, the construction of the stair system 200 may be simplified.

Figure 3:
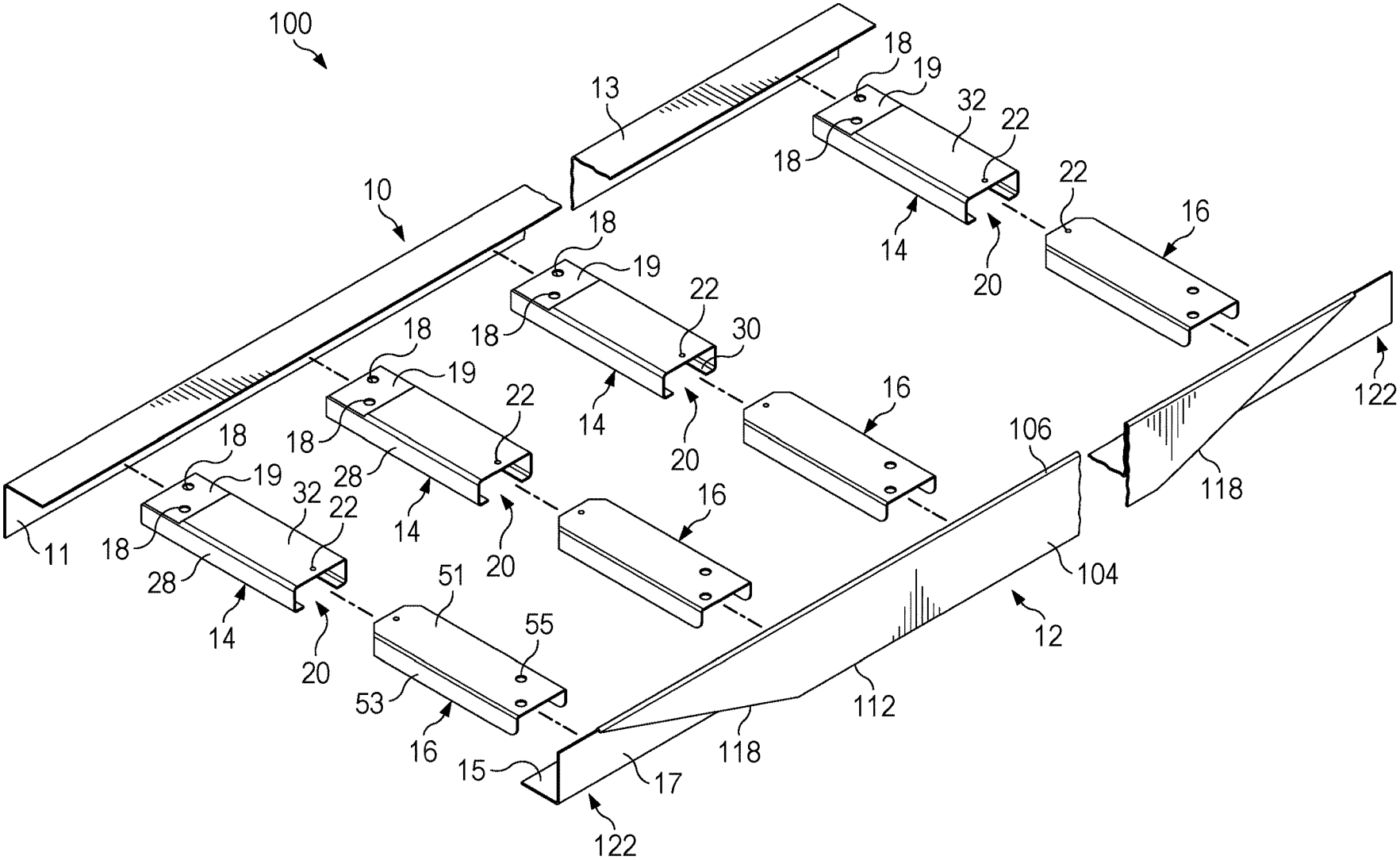
FIG. 3 is an exploded, perspective view of a reinforced adjustable stair tray assembly according to an embodiment of this present disclosure.

FIG. 3 is an exploded perspective view of an embodiment of the reinforced adjustable stair tray assembly 100. The reinforced adjustable stair tray assembly 100 includes a front weldment and a rear weldment. According to an embodiment, the front weldment provides the track for the adjustability of the depth dimension, as will be explained in more detail below. The front weldment includes a front angle bar 10 and a plurality of track channels 14. The front angle bar 10 includes a horizontal wall 13 and a vertical wall 11 extending downward from the horizontal wall 13. The rear weldment includes a rear reinforced angle bar 12 and a plurality of U-channels 16. The rear reinforced angle bar 12 includes a horizontal wall 15 and a vertical wall 17 extending upward from the horizontal wall 15. The reinforced angle bar 12 also includes a reinforcing flange 104 extending downwardly from the vertical wall 17.

The front weldment may be formed by positioning the horizontal wall 13 of the front angle bar 10 in depressions 19 of multiple track channels 14. Spot welds may be formed using the weld holes 18 to permanently join the front angle bar 10 to the track channels 14. The depressions 19 facilitate a discontinuous level surface across the reinforced adjustable stair tray assembly 100 to support the tread that will be secured to the reinforced adjustable stair tray assembly 100.

According to an embodiment, the track channels 14 are generally C-shaped in cross section and include an upper wall 32, a pair of opposed lateral walls 28, and a pair of spaced-apart floor walls 30 which collectively define a cavity 20. The track channel 14 includes an opening on each end. The opening of the end opposite of the front angle bar 10 receives the U-channel 16, as discussed in more detail below. The open bottom portion of the track channel 14 provides access to the weld holes 18 from the underside of the track channels 14 to facilitate spot welding of the angle bar 10 to each track channel 14. Alternatively, the track channel 14 may be in the form of a tube with a rectangular cross-section where the underside is closed by a continuous wall. The term U-channel is not limited to only U-shaped components. Any suitable shape that may be received by the cavity 20 of the track channel 14 is contemplated by this disclosure.

Each U-channel 16 includes an upper wall 51 and a pair of opposed lateral walls 53 extending from the upper wall 51. One or more weld holes 55 may be formed in the upper wall 51 to facilitate securing the U-channels 16 to the rear reinforced angle bar 12. The U-channels 16 are secured to the rear reinforced angle bar 12, for example by welding. According to an embodiment, the horizontal wall 15 of the rear reinforced angle bar 12 is placed on the upper surfaces 51 of the U-channels 16. A welder may access the weld holes 55 from the underside of the U-channels 16 to weld the U-channels 16 to the horizontal wall 15 of the rear reinforced angle bar 12. The U-channels 16 may include a tapered end of the upper wall 51 to facilitate insertion into the respective track channel 14.

Other methods of securing the track channels 14 and the U-channels 16 to the angle bars 10, 12 are contemplated by this disclosure, including securing with fasteners or adhesive.

Each of the angle bars 10, 12, track channels 14, and U-channels 16 may be formed of a metal, such as aluminum or light gauge steel, for example ASTM A36 steel, which may be roll formed into the illustrated shapes. Alternatively, each of the angle bars 10, 12, track channels 14, and U-channels 16 may be formed of Q235 plain carbon structural steel. According to one embodiment, the angle bars 10, 12, track channels 14, and U-channels 16 are each formed of steel with a thickness of approximately 3/16 inches, but may be thinner for lighter stairways, or may be thicker for heavier stairways. For example, the thickness of the steel of angle bars 10, 12, track channels 14, and U-channels 16 may be in a range of 0.1 to 0.5 inches. The roll forming may create a rounded transition at the junction of the walls. For example, a rounded transition may be formed at the junction of the track channel upper wall 32 and the respective lateral wall 28 and/or at the transition of the floor wall 30 to the respective lateral walls 28.

In some embodiments, the upper wall 32 of the track channel 14 also includes a through hole 22. The upper wall 51 of the U-channel 16 may also include a through hole 22. The through holes 22 may allow the track channel 14 and the U-channel 16 to be hung for powder galvanization and/or powder coating or other surface treatment during manufacturing. Alternatively, any of the through holes 22 may receive a fastener to set a desired stair tray depth of the reinforced adjustable stair tray assembly 100.

Figure 4:
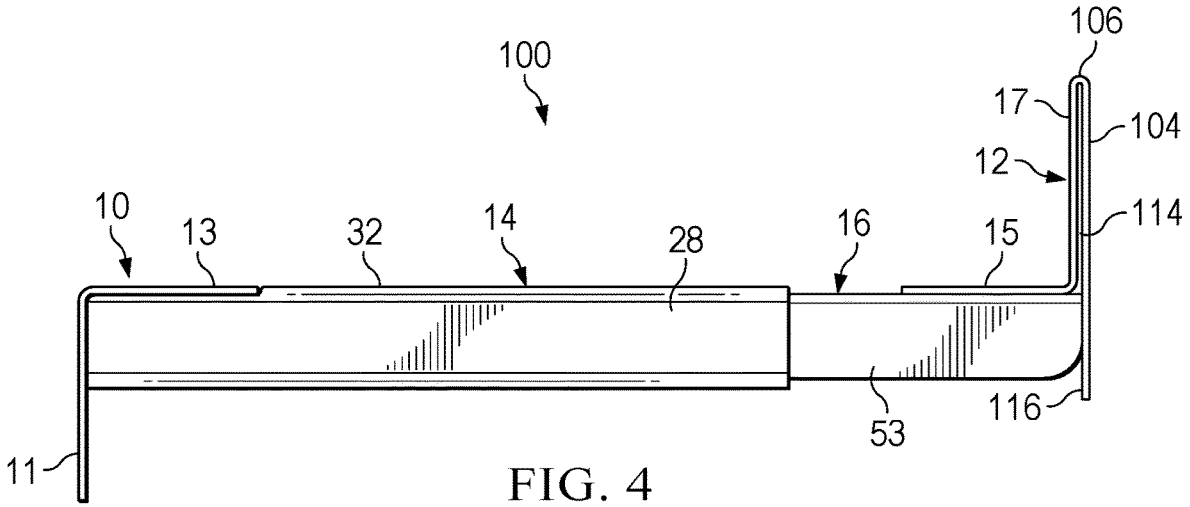
FIG. 4 is a side, elevation view of a reinforced adjustable stair tray according to a reinforced embodiment of the present disclosure.

FIG. 3 also shows a rear, perspective view of the reinforced angle bar 12. FIG. 4 shows a profile view of the reinforced angle bar 12. The reinforced angle bar 12 includes a reinforcing flange 104 to increase the strength of the angle bar 12. More specifically, if a load is applied to an area approximately at the mid-point along the length of the reinforced angle bar 12, the reinforcing flange 104 increases the strength of the reinforced angle bar 12 to yielding and tending to bend in a U-type configuration where the middle portion deflects downward, and each distal end deflects upward. According to an embodiment, a 180-degree bend 106 is located at the junction of the reinforcing flange 104 and the vertical wall 17 of the angle bar 12. A metal forming process called hemming may be used to form the reinforcing flange 104. Specifically, the reinforcing flange 104 may be a flat hem. The reinforcing flange 104 extends downward vertically from the 180-degree bend 106. The reinforced angle bar 12 also includes the horizontal wall 15 extending orthogonally from the vertical wall 17. A lower edge 112 of the reinforcing flange 104 is disposed below the horizontal wall 15. According to an embodiment, the lower edge 112 extends approximately 1.2 inches below the horizontal wall 15.

With reference to FIG. 4, a rear surface 114 of the vertical wall 17 abuts a front surface 116 of the reinforcing flange 104. The reinforcing flange 104 includes opposed angled edges 118. The angled edges 118 allow for less material to be used for the reinforcing flange 104 at the distal areas where loads on the angle bar 12 are more directly opposed by the stair stringer assembly including the stair tray support brackets 26 and the stair stringer 24. According to an embodiment, the angled edge 118 forms an approximately 20-degree angle with the horizontal. The reinforcing flange 104 is disposed between the stair tray support brackets 26 on each side of the reinforced angle bar 12. A bracket abutting portion 122 of the vertical wall 17 abuts the stair tray support bracket 26 adjacent and above it (see FIGS. 6A and 6B). According to an embodiment, the bracket abutting portion 122 includes about 2 inches on each end of the length of the vertical wall 17. More specifically, the bracket abutting portion 122 is a portion of the rear surface 114 of the vertical wall 17.

According to an embodiment, a four-foot-long reinforced adjustable stair tray 100 including the reinforced angle bar 12 can span the full four-foot length supported by only two stair stringers 24, one on each side of the reinforced adjustable stair tray 100. The reinforced angle bar 12 is manufactured by using known sheet metal forming processes to bend and form a sheet of Q235 plain carbon structural steel into the configuration shown and described. Other suitable materials, such as ASTM A36 steel, are contemplated by this disclosure. According to alternate embodiments, the reinforced adjustable stair tray 100 may be any suitable length, such as lengths of five-feet, six-feet, ten-feet, or twelve-feet.

According to an embodiment of the present disclosure, a reinforced adjustable stair tray 100 including the reinforced rear angle bar 12 supported by only a pair of stair stringers 24 disposed at each end of the reinforced adjustable stair tray 100 supports a load of approximately 300 pounds applied at an area including the mid-point of the length of the reinforced angle bar 12 without yielding. Such support may comply with certain code requirements for stair structures.

Reference is now made to FIG. 4, which depicts a side elevation view of the reinforced adjustable stair tray assembly 100. The plurality of track channels 14 telescopically receive a corresponding plurality of U-channels 16. According to an alternate embodiment, each one of the plurality of track channels 14 is a hollow rectangular tube. With the horizontal wall 13 seated in the depression 19, the upper surface of the horizontal wall 13 of the front angle bar 10 is co-planar with the upper surface of the upper wall 32 of the track channel 14. A discontinuous tread mounting surface is made up of the horizontal wall 13 of the front angle bar 10, the upper surface 32 of the track channel 14, and the horizontal wall 15 of the rear reinforced angle bar 12. As shown, the tread mounting surface includes the upper surface of the horizontal wall 13 of the front angle bar 10, which is co-planar with the upper surface of the upper wall 32 of the track channel 14, and these surfaces are co-planar with the upper surface of the horizontal wall 15 of the rear reinforced angle bar 12. Thus, stair treads 108 may be mounted to the tread mounting surface and the tread surface will be level.

Figure 5A:
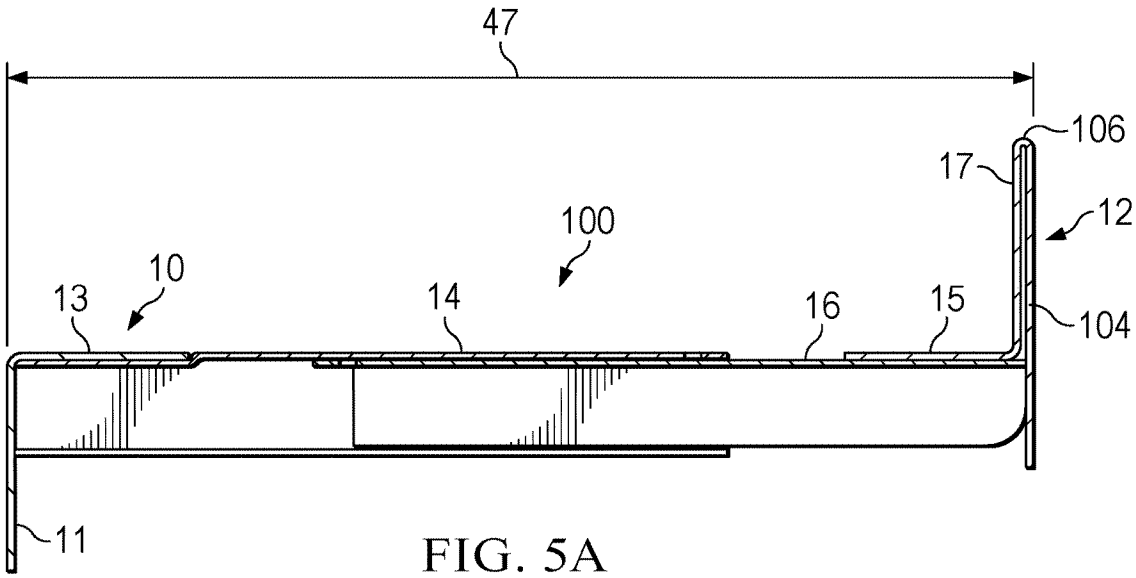
FIGS. 5A and 5B are side, cross-sectional views of an embodiment of the reinforced adjustable stair tray assembly positioned at two different stair tray depths.
Figure 5B:
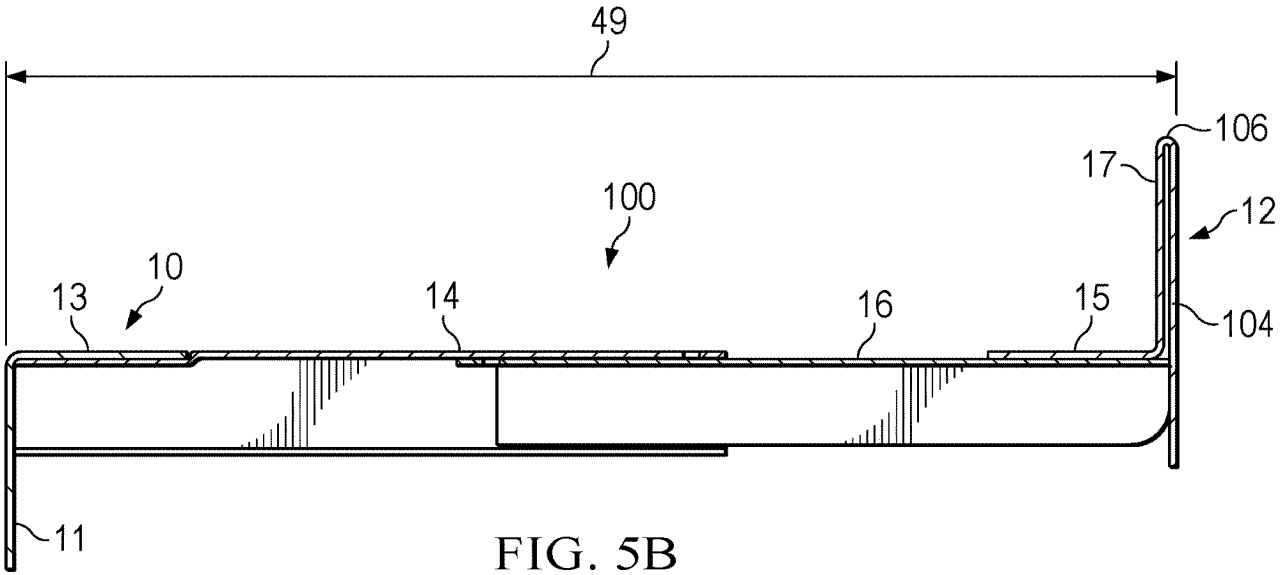

Reference is now made to FIGS. 5A and 5B, which depict side cross-sectional views of the reinforced adjustable stair tray assembly 100 at a first stair tray depth 47 shown in FIG. 5A, and at a second, extended stair tray depth 49 shown in FIG. 5B. The depths 47, 49 are measured as the distance from the front surface of the vertical wall 11 of the front angle bar 10 to the front surface of the vertical wall 17 of the rear reinforced angle bar 12. As shown in FIG. 5A, as the U-channels 16 are inserted further into the track channels 14, the stair tray depth 47 becomes shorter. Whereas, as shown in FIG. 5B, the U-channels 16 are telescopically extended within the track channels 14, and therefore the stair tray depth 49 is greater than the depth 47.

The U-channels 16 are configured to be received by the cavity 20 in the track channels 14. As the U-channels 16 are inserted into the track channels 14, lower surfaces of the lateral walls of the U-channels 16 slide across the upper surfaces of the respective floor walls 30 of the track channels 14. In this manner, the U-channels 16 can be telescopically adjusted further into the track channels 14 or further out of the track channels 14 to adjust to the adjustable stair tray assembly 100 to the desired stair tray depth. As the U-channel 16 is adjusted farther into the track channel 14, the overall stair tray depth becomes shorter. As the U-channels 16 are adjusted farther out of the track channels 14, the overall stair tray depth becomes greater.

Figure 6A:
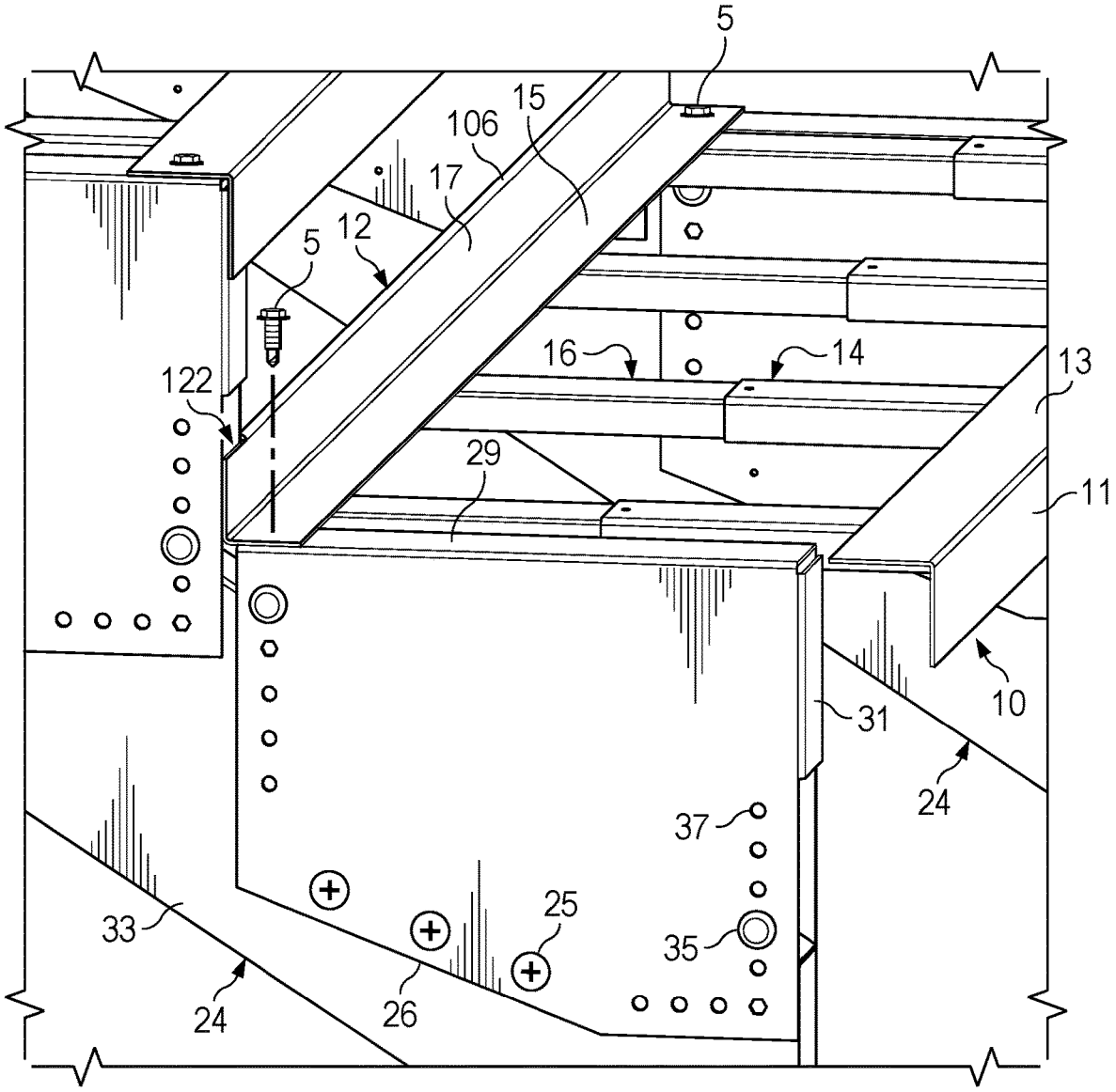
FIGS. 6A and 6B are perspective views of a portion of a reinforced adjustable stair assembly showing steps in a process of installing a reinforced adjustable stair tray to a stringer assembly.
Figure 6B:
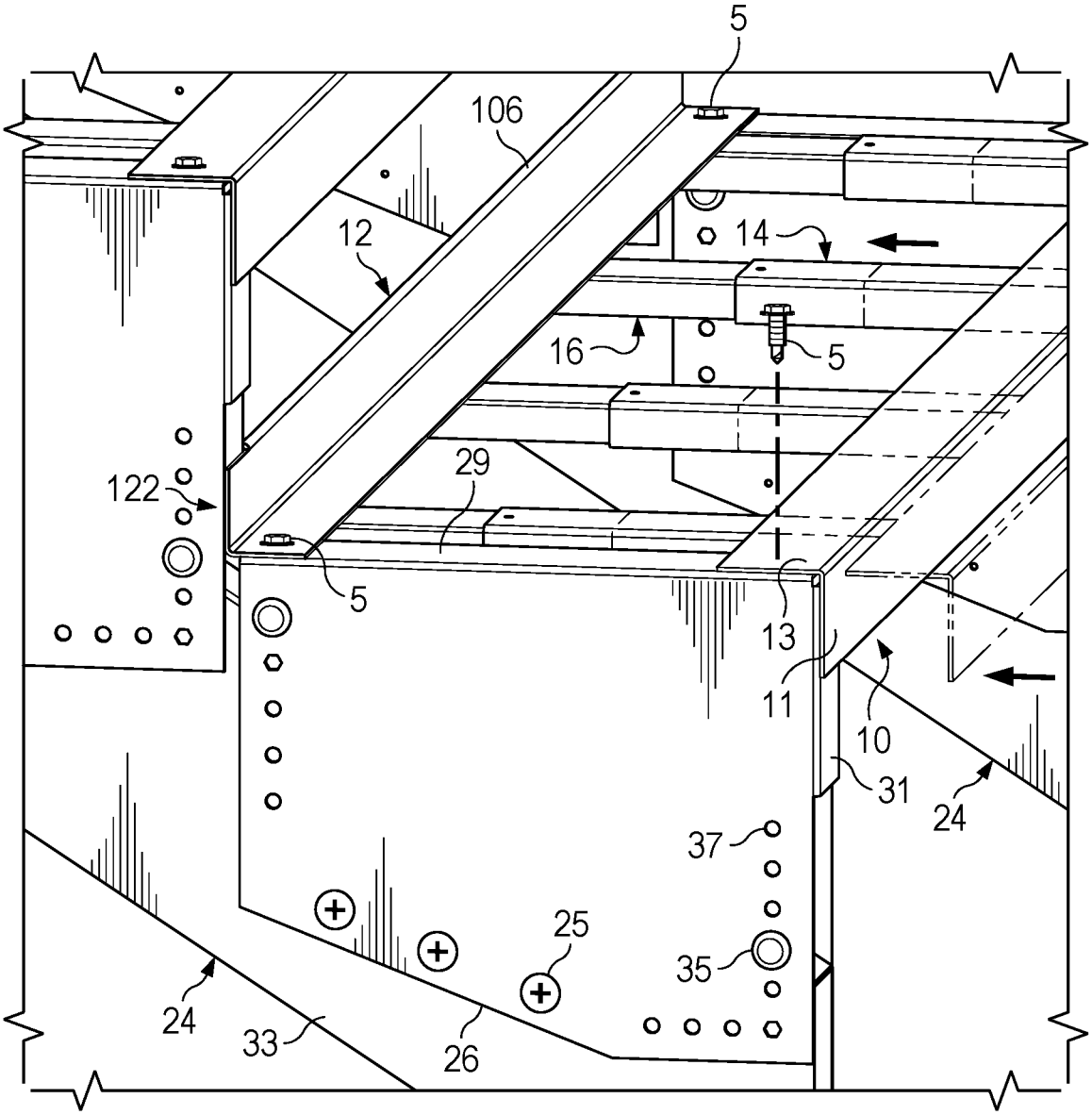

Reference is now made to FIGS. 6A and 6B, which are perspective views illustrating steps in a process of installing the reinforced adjustable stair tray assembly 100 according to an embodiment of the present disclosure. The stair tray support brackets 26 are positioned using the set pins 35 and fastened to the stair stringer 24 at the appropriate horizontal spacing from each other using the fasteners 25. A reinforced adjustable stair tray 100 may be cut on each side to correspond to a spacing of the stair stringers 24. Next, a reinforced adjustable stair tray assembly 100 is extended to a depth that is greater than the final depth at which it will be fastened. According to an embodiment, the installer uses a rubber mallet on either the front or rear angle bar 10, 12 while holding the other angle bar 10, 12 stationary. Hitting the angle bar with the rubber mallet will cause the adjustable stair tray assembly to extend and increase in depth. The installer should use care to not unintentionally separate the front weldment from the rear weldment.

The rear reinforced angle bar 12 is positioned with the bracket abutting portion 122 of the vertical wall 17 contacting the stair tray support bracket 26 immediately above it on the stringer 24. A fastener 5, such as a self-drilling screw, is inserted through the horizontal wall 15 of the rear reinforced angle bar 12 and into the upper wall 29 of the stair tray support bracket 26. A second fastener 5 is secured to the corresponding stair tray support bracket 26 supported by the stringer 24 on the opposite side of the stair system 200.

Next, the installer may use a rubber mallet to urge the front angle bar 10 to retract toward the rear reinforced angle bar 12 and thereby retract the assembly and reduce the stair tray depth. Upon contact with the vertical wall 11 of the front angle bar 10 to the stair tray support bracket 26, as shown in FIG. 6B, the required adjustable stair tray depth is set. The installer may then insert fasteners 5 through the horizontal wall 13 of the front angle bar 10 and into the upper wall 29 of the stair tray support bracket 26. A second fastener 5 is then inserted through the horizontal wall 13 of the angle bar 10 and through the upper wall 29 of the corresponding stair tray support bracket 26 supported by the opposite stringer 24.

Stair treads 108 (See FIG. 1) are then secured to the installed reinforced adjustable stair tray assemblies. According to an embodiment, shallow blind holes are drilled in the underside of the treads to accommodate the heads of the fasteners 5 and allow the tread to sit flush on the adjustable stair tray 100.

According to some embodiments, the stair system 200 is configured to have a width that only requires a pair of stringers 24 to support the reinforced adjustable stair tray assemblies 100. According to other embodiments, the stair system 200 may have a width that may be supported by a third stair stringer assembly disposed between two outer stair stringer assemblies or four stair stringers.

Figure 7A:
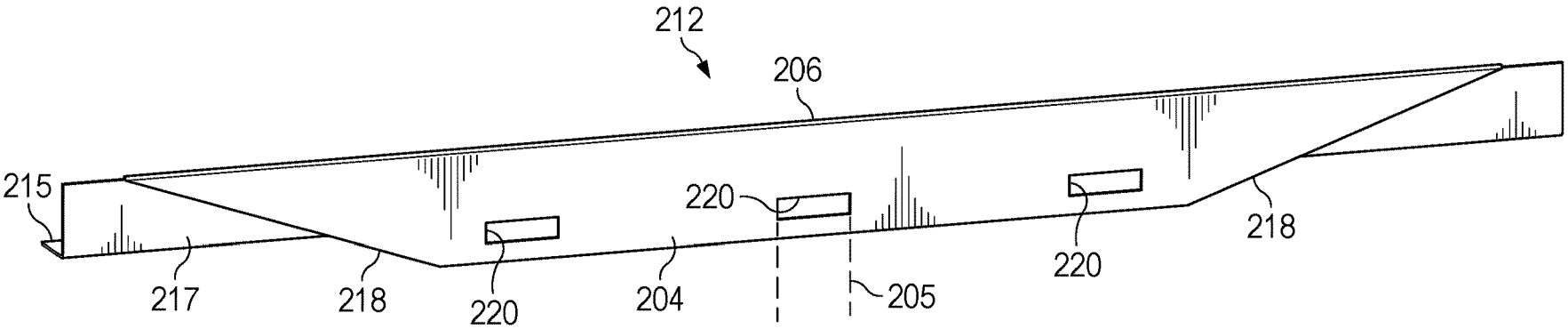
FIGS. 7A and 7B are rear, perspective views of an alternate embodiment of a rear reinforced angle bar according to the teachings of the present disclosure.
Figure 7B:
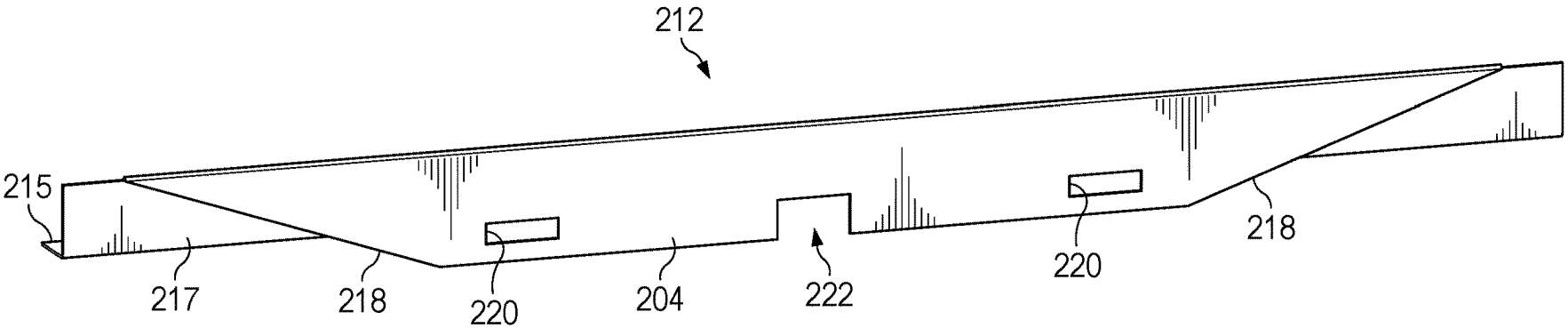

Reference is made to FIGS. 7A and 7B, which are rear, perspective views of a reinforced angle bar 212 with a plurality of punch outs 220. As discussed above with respect to FIG. 3, a reinforcing flange 204 extends below a horizontal wall 215. When it is desired to accommodate one or more additional stair stringers, the punch outs 220 facilitate forming one or more notches 222 that provide clearance for the stair tray support brackets of the additional stair stringers (see FIG. 8). The rear reinforced angle bar 212 includes three punch outs 220 spaced apart along the reinforcing flange 204. The three punch outs 220 are spaced apart to accommodate either one central stringer, two, or three central stringers, depending on the desired strength of the stairway. The rear reinforced angle bar 212 includes a horizontal wall 215 and a vertical wall to 217. The reinforcing flange 204 includes a pair of opposed angled edges 218. A bend 206, which may be formed by a hemming metal forming process, is located at the junction of the vertical wall 217 and the reinforcing flange 204.

The punch outs 220 may be formed using a metal punch press. According to an embodiment, the punch press forms the punch outs 220 in the sheet metal before the sheet is brake formed, or otherwise bent, into the final configuration of the rear reinforced angle bar 212 shown in FIGS. 7A and 7B.

FIG. 7B shows the center punch out 220 formed as a notch 222. To form the notch 222 a contractor may use a grinder or other metal cutting tool to make two cuts of the reinforcing flange 204 at approximately the location of cut lines 205, which allows the metal directly below the punch out 220 to be removed. In this manner, the notch 222 is easily cut into the reinforcing flange 204. This disclosure contemplates forming the notch 222 without the preformed punch outs 220. However, in certain embodiments, the thickness of the sheet metal forming the rear reinforced angle bar 212 may make cutting the notch 222 without the punch outs 220 more difficult. The punch outs 220 simplify forming the notches 222 and do not appreciably decrease the strength of the reinforced adjustable stair tray 202. That is, a stairway may be constructed with two stair stringers disposed at each end with the reinforced adjustable stair tray assemblies 220 including the punch outs 220.

Figure 8:
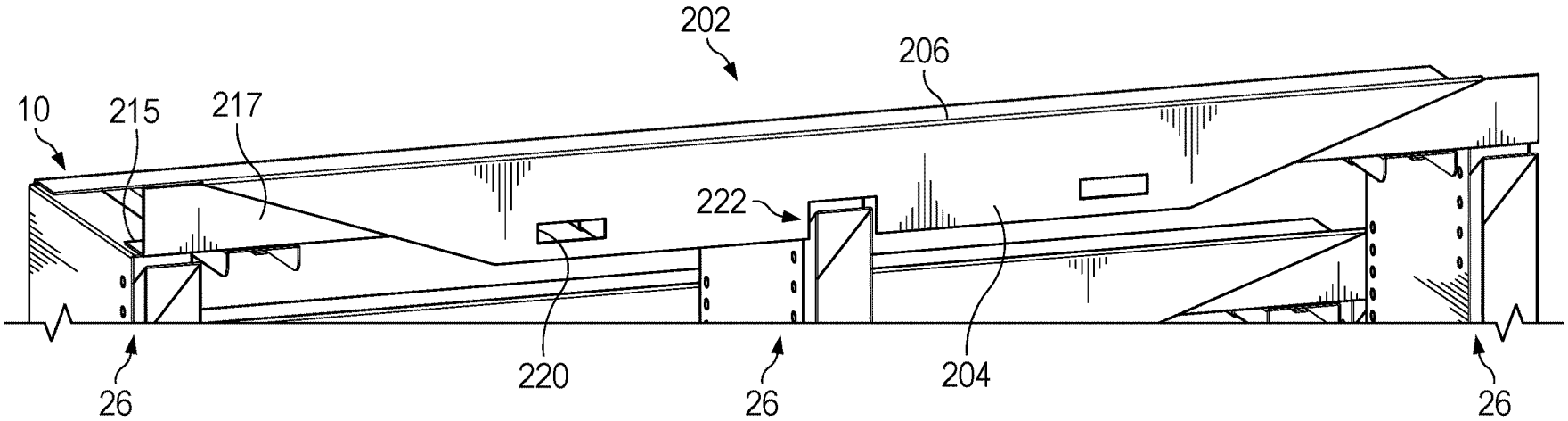
FIG. 8 is a rear, perspective view of a portion of an adjustable stair system with an embodiment of a reinforced adjustable stair tray assembly constructed with a center support stair stringer in addition to two stair stringers disposed on each end.

FIG. 8 is a rear perspective view of a portion of a stairway employing the reinforced adjustable stair tray assemblies 202 supported by a central stair stringer represented by a stair tray support bracket 26 disposed between the stair tray support brackets 26 located at each end of the reinforced adjustable stair tray assembly 202. The center notch 222 provides clearance and receives a portion of the stair tray support bracket 26 supported by the center stair stringer. The notch 222 provides clearance such that the horizontal wall 215 of the rear reinforced angle bar 212 rests on the top surface of the stair tray support bracket 26.

An alternative embodiment, the punch outs 220 on either side are used to make simplified cuts into the reinforcing flange 204 to form the notches 222 that provide clearance to accommodate two central stringers (not shown) for stairways supported by four stair stringers as opposed to two stair stringers or three stair stringers. The reinforced adjustable stair trays 202 are secured to the third or third and fourth stair stringer assembly as described above with respect to the reinforce adjustable stair trays 100 shown in FIG. 1.

Even though the notches 222 may reduce the strength to oppose yielding of the reinforced adjustable star tray 202, the additional stair stringers accommodated by the notches 222 provide sufficient strength of the overall stairway system to meet certain codes or to be constructed with minimal unintended flexibility of the individual steps. Thus, the reinforcing flange 204 may not be necessary if the stairway is constructed with more than two stair stringers.

As used herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the figures. It should be noted that the orientation of various elements may differ according to other exemplary embodiments, and that such variations are intended to be encompassed by the present disclosure.

Although the figures and description may illustrate a specific order of method steps, the order of such steps may differ from what is described, unless specified differently above. Also, two or more steps may be performed concurrently or with partial concurrence, unless specified differently above. All such variations are within the scope of the disclosure.

It is important to note that the construction and arrangement of the assemblies as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A reinforced adjustable stair tray assembly, comprising:
- a first angle bar;
- a plurality of track channels coupled to the first angle bar and each defining a cavity;
- a second angle bar comprising a horizontal wall, a vertical wall extending from the horizontal wall, and a reinforcing flange extending downwardly from the vertical wall;
- a plurality of U-channels coupled to the second angle bar;
- each one of the plurality of U-channels received in a respective cavity of each of the plurality of track channels; and
- the plurality of U-channels being telescopically adjustable within the plurality of track channels to adjust a tray depth.

2. The reinforced adjustable stair tray assembly of claim 1 wherein each of the U-channels comprises an upper wall and opposed side walls and each one of the upper walls is tapered; and each of the track channels comprises at least one floor wall supporting at least one of the opposed side walls of the corresponding U-channel.

3. The reinforced adjustable stair tray assembly of claim 2 wherein each of the track channels comprises a plurality of floor walls, each supporting one of the opposed side walls of the U-channel.

4. The reinforced adjustable stair tray assembly of claim 1 further comprising a bend disposed between the vertical wall and the reinforcing flange.

5. The reinforced adjustable stair tray assembly of claim 4 wherein the bend is a hem.

6. The reinforced adjustable stair tray assembly of claim 1 wherein the reinforcing flange comprises a pair of opposed angled edges.

7. The reinforced adjustable stair tray assembly of claim 1 wherein the reinforcing flange comprises a lower edge disposed below the horizontal wall and the reinforcing flange defines at least one punch out.

8. The reinforced adjustable stair tray assembly of claim 1 wherein the vertical wall comprises a pair of abutting portions each disposed at a distal end of the vertical wall.

9. The reinforced adjustable stair tray assembly of claim 1 wherein the first angle bar comprises a second vertical wall and the tray depth is a horizontal distance from the vertical wall to the second vertical wall.

10. The reinforced adjustable stair tray assembly of claim 9, wherein a difference between a first tray depth and a second tray depth is at least one inch.

11. The reinforced adjustable stair tray assembly of claim 10 wherein the difference between the first tray depth and the second tray depth is about two inches.

12. The reinforced adjustable stair tray assembly of claim 1, wherein each one of the plurality of track channels is a hollow rectangular tube.

13. The reinforced adjustable stair tray assembly of claim 1 wherein each one of the plurality of track channels is welded to the first angle bar and each one of the plurality of U-channels is welded to the second angle bar; and an upper surface of each track channel is level with an upper surface of a horizontal wall of the second angle bar.

14. A stair assembly, comprising:
- a plurality of stair stringers;
- a plurality of stair tray support brackets configured to couple to one of the plurality of stair stringers;
- a plurality of adjustable stair tray assemblies configured to be supported by at least two of the plurality of stair tray support brackets, each one of the plurality of adjustable stair tray assemblies, comprising:
  - a first angle bar;
  - a plurality of track channels coupled to the first angle bar and each defining a cavity;
  - a second angle bar comprising a horizontal wall, a vertical wall extending from the horizontal wall, and a reinforcing flange extending downwardly from the vertical wall;
  - a plurality of U-channels coupled to the second angle bar;
  - each one of the plurality of U-channels received in a respective cavity of each of the plurality of track channels; and
  - the plurality of U-channels being telescopically adjustable within the plurality of track channels to adjust a tray depth.

15. The stair assembly of claim 14 wherein each of the plurality of stair tray support brackets comprises a plurality of set pin receiving holes corresponding to multiple incline angles of the adjustable stair assembly.

16. The stair assembly of claim 14 further comprising a bend disposed between the vertical wall and the reinforcing flange.

17. The stair assembly of claim 16 wherein the bend is a hem.

18. The stair assembly of claim 14 wherein the reinforcing flange defines at least one punch out.

19. A reinforced adjustable stair tray assembly, comprising:

a first angle bar;

a plurality of U-channels coupled to the first angle bar;

a second angle bar comprising a horizontal wall, a vertical wall extending from the horizontal wall, and a reinforcing flange extending downwardly from the vertical wall, and a bend disposed between the vertical wall and the reinforcing flange;

a plurality of track channels coupled to the second angle bar and each defining a cavity;

each one of the plurality of U-channels received in a respective cavity of each of the plurality of track channels; and the plurality of U-channels being telescopically adjustable within the plurality of track channels to adjust a tray depth.

20. The reinforced adjustable stair tray assembly of claim 19 wherein the bend is a 180-degree bend.

* * * * *